US007882959B1

(12) United States Patent
Augst

(10) Patent No.: US 7,882,959 B1
(45) Date of Patent: Feb. 8, 2011

(54) METHOD AND APPARATUS FOR SCALPING FOOD PIECES

(75) Inventor: Elliot Augst, Minneapolis, MN (US)

(73) Assignee: General Mills IP Holdings II, LLC, Minneapolis, MN (US)

( * ) Notice: Subject to any disclaimer, the term of this patent is extended or adjusted under 35 U.S.C. 154(b) by 0 days.

(21) Appl. No.: 12/536,706

(22) Filed: Aug. 6, 2009

(51) Int. Cl.
*B07B 1/10* (2006.01)

(52) U.S. Cl. ..... 209/308; 209/265; 209/240; 209/241; 209/309

(58) Field of Classification Search ..... 209/235, 209/240, 241, 264, 308, 309, 325
See application file for complete search history.

(56) References Cited

U.S. PATENT DOCUMENTS 2,124,475 A * 7/1938 Smith et al. ..... 209/399
2,157,839 A * 5/1939 Werthelmer ..... 426/96
2,617,532 A * 11/1952 Gorton ..... 209/247
2,997,172 A * 8/1961 Wright ..... 209/33
3,746,546 A 7/1973 Bateson et al.
4,094,633 A 6/1978 Peterson et al.
4,193,758 A 3/1980 Peterson et al.
4,652,362 A * 3/1987 Mueller ..... 209/44.2
4,888,885 A * 12/1989 Caughey ..... 34/503
5,183,160 A * 2/1993 McClain ..... 209/234
5,268,100 A * 12/1993 Hartzell ..... 210/396

* cited by examiner

*Primary Examiner*—Terrell H Matthews
(74) *Attorney, Agent, or Firm*—John A. O'Toole; Everett G. Diederiks

(57) ABSTRACT

A method and apparatus for separating multiple food pieces and removing clumps from food pieces in order to process individual pieces for subsequent packaging includes a vibrating conveyor bed which receives a substantially continuous supply of a dried product, such as RTE cereal or another snack product, and delivers the dried product to a screen unit including a plurality of spaced slots through which only individual food pieces can pass for further processing. Prior to the screen unit, the bed can be provided with an upstanding deflector member which diverts the traveling food product away from a discharge chute and onto the screen unit. In any case, the screen unit includes an upwardly angling portion, extending away from the discharge chute, for retaining product which needs to be further processed, while the discharge chute also has an associated, raised lip for product retention purposes.

21 Claims, 7 Drawing Sheets

METHOD AND APPARATUS FOR SCALPING FOOD PIECES

BACKGROUND OF THE INVENTION

The present invention pertains to the art of food production and, more particularly, to a scalper system and method for removing clumps of food product from single product pieces. The invention has particular application in separating food clumps from individual cereal pieces.

Various food products are intended to be formed as individual pieces. However, given the rate at which the food products are produced for mass production, it is not uncommon for either multiple food products to be stuck together or extra clumps of food to be attached to the individual pieces. In these situations, provisions are often made to separate or remove the additional food material in order to establish the individual pieces for subsequent processing and packaging. For instance, it is known to produce various individual food products from cereal dough. Such products include Ready-to-Eat (RTE) cereals, often referred to as breakfast cereals, and other snack products. These products can be prepared in a wide variety of shapes, sizes, compositions, textures, flavors and the like. After these products are formed from the cereal dough, and perhaps coated with a sugary slurry, the products need to be dried. After the drying phase, it will be found that some of the hardened pieces are stuck together and/or a sugary build-up from a hardened sugar slurry is clumped onto the individual pieces. Prior to further processing of the food product, it is desirable to separate any pieces which are stuck together and remove any clumps from the single food pieces.

In the past, this separation function has been performed by discharging the food pieces onto an elongated, vibrating screen. Basically, the screen is defined by a series of metal grates having numerous holes or slots along their entire lengths. The shaking of the screen, in combination with the inherent edges established by the screen, would cause multiple pieces to break apart and additional, clumped material to be broken off as the individual pieces are conveyed along the screen. By the time the pieces made their way to the end of the elongated screen, the substantial majority of the food product would be defined by individual, discrete pieces.

Certainly, it is not uncommon for a single production line to be used for making various distinct products. In making individual food products in accordance with the present invention, when a product changeover is to occur, the entire scalper system needs to be cleaned. As can be imagined, cleaning an elongated screen is quite time consuming. In fact, in some instances, a single scalper can require two hours to clean. Obviously, this period adds to overall production down time and results in production inefficiencies.

SUMMARY OF THE INVENTION

The present invention is directed to a method and apparatus for separating multiple food pieces and removing clumps from food pieces in order to process individual pieces for subsequent packaging. In accordance with the invention, the apparatus includes a vibrating conveyor pan or bed which receives a substantially continuous supply of a dried product, such as RTE cereal or another snack product. The conveyor bed leads to a terminal screen unit arranged adjacent a discharge zone of the apparatus. The screen unit includes a plurality of spaced slots through which the individual food pieces must pass for further processing. In accordance with one embodiment of the invention, prior to the screen unit, the bed is provided with an upstanding deflector member which directs the traveling food pieces away from a discharge chute and assures that all the food pieces flow onto at least a portion of the screen unit. Remote from the deflector member, the screen unit includes an upwardly angling portion, extending away from the discharge chute, for retaining product which needs to be further processed.

Prior to being discharged onto the bed, the food pieces are dried so that the pieces on the bed are somewhat hard. The application of a vibrating effect causes the pieces to travel to the screen unit. Product approaching the screen unit on the side of the discharge chute is deflected away from the discharge chute and onto the screen unit. Individual product pieces of desired size are permitted to fall through the openings in the screen unit, either leading directly to another production device or onto a lower pan which is also vibrated in order to convey the product pieces to the production device. If two or more pieces are stuck together or additional material is clumped on a product piece, those pieces will interact with portions of the screen unit, such as the edges of the openings, in order to scalp the food pieces to the point where the pieces can fall through the openings. Large or clumped pieces which have not been sufficiently reduced in size will tend to work their way to the upwardly sloping portion of the screen unit and gather. These pieces can then be directed, either manually or otherwise, to the discharge chute.

With the above arrangement, an extremely effective and efficient piece scalping and separating system is established. When it is time for a product changeover, the substantial smooth bed and screen unit can be readily cleaned. Although not a requirement, the screen unit can be made removable such that the screen can be replaced, such as with another screen unit with different sized openings depending on the product being produced. Most preferably, the entire bed and screen unit is configured as a wheeled, transportable assembly which can be readily replaced or repositioned with minimal effort.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE INVENTION

Figure 1:
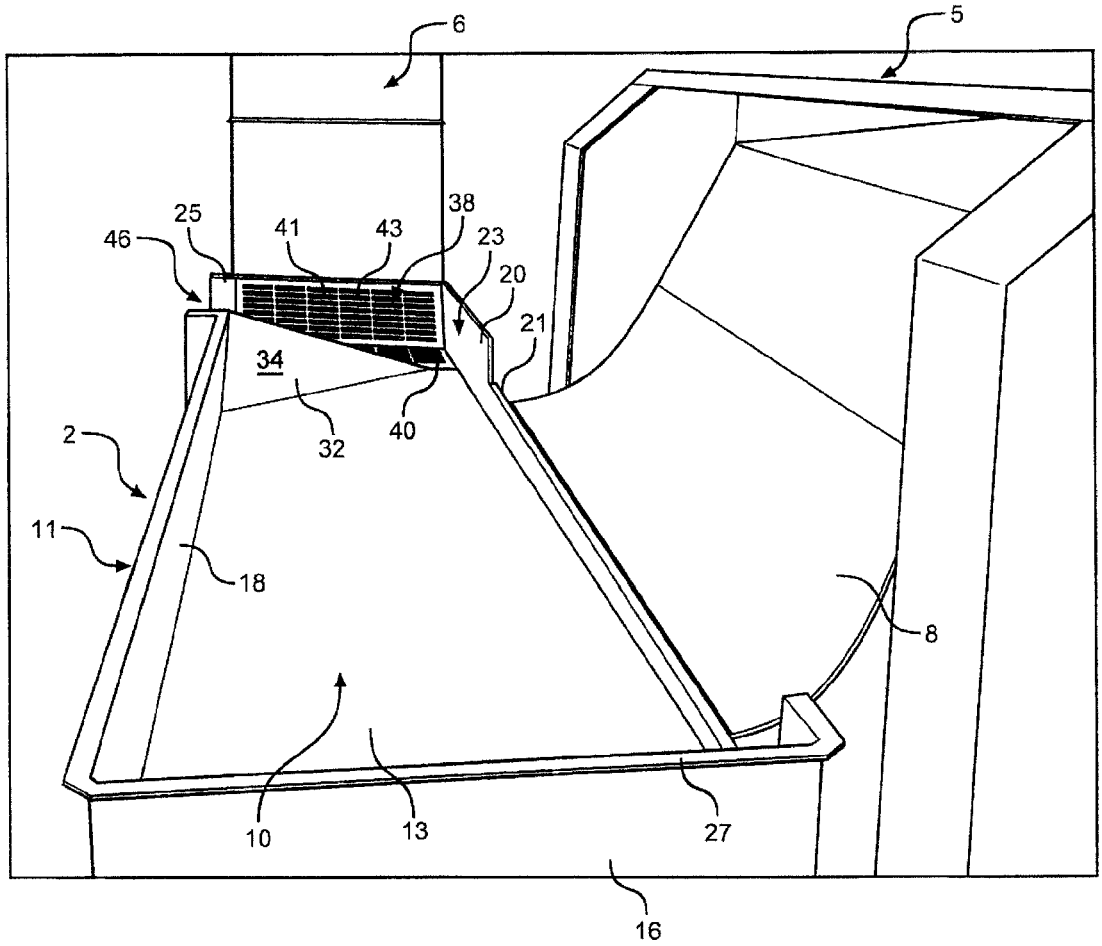
FIG. 1 is a perspective view of the apparatus of the invention in a downstream direction.

With initial reference to FIG. 1, a scalping apparatus constructed in accordance with the present invention is indicated at 2. In general, scalping apparatus 2 is positioned between first and second spaced processing stations 5 and 6 in an overall food production facility. As will be discussed more fully below, scalping apparatus 2 is particularly adapted for use in separating multiple food pieces and removing excess clumps of food material from food pieces in order to establish individual, discrete pieces for subsequent processing and packaging. Although apparatus 2 can be employed in connection with making various types of individual snack product pieces, the invention is particularly adapted for use in connection with making Ready-to-Eat (RTE) cereal pieces, especially puffed cereal pieces. In accordance with the present embodiment, processing station 5 constitutes a dryer, while processing station 6 constitutes a pneumatic conveyor.

As shown, processing station 5 includes an associated discharge ramp 8 which leads to a first end portion 10 of a bed 11 defining part of scalping apparatus 2. As depicted, bed 11 includes a smooth platform 13 in first end portion 10, a first upstanding end wall 16, a first upstanding side wall 18, a second upstanding side wall 20 having a cut-out section 21 juxtaposed discharge ramp 8, and a second end portion 23 having an associated second upstanding end wall 25. As shown, portions of bed 11, such as long first upstanding end wall 16 and first upstanding side wall 18, can be provided with an out-turned, upper rim 27.

In the embodiment shown, extending laterally across a majority of bed 10 at a position directly adjacent second end portion 23 is a deflector member 32. As shown, deflector member 32 is raised above the substantially smooth platform 13 from a height generally commensurate with first upstanding side wall 18, while deflector member 32 tapers down to platform 13 prior to second upstanding side wall 20. FIG. 1 shows deflector member 32 including a triangular-shaped pyramid surface 34 exposed along the path from first end portion 10 to second end portion 23. As will be described more fully below, deflector member 32 functions to divert food product conveyed along bed 11 along a desired flow path.

Figure 4:
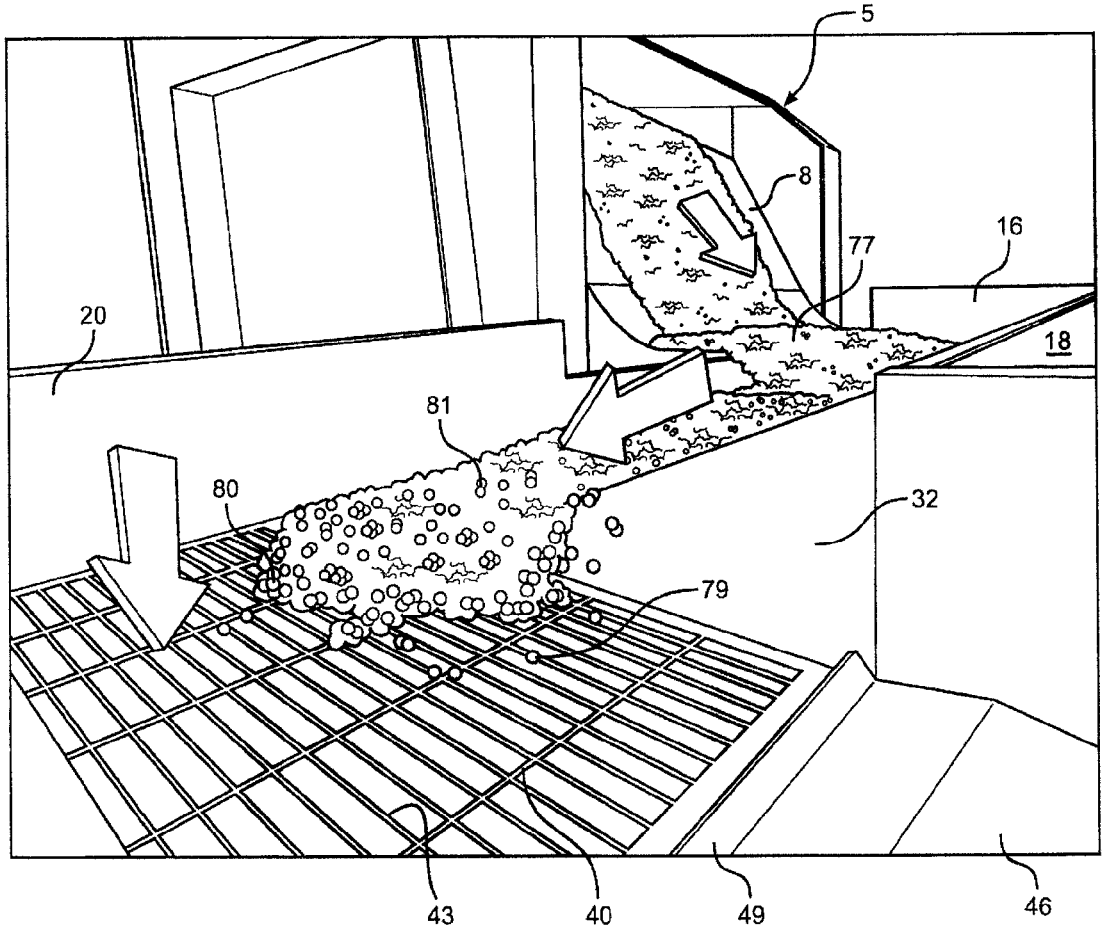
FIG. 4 shows the product pieces being directed around a deflector member and onto a screen unit of the apparatus.
Figure 5:
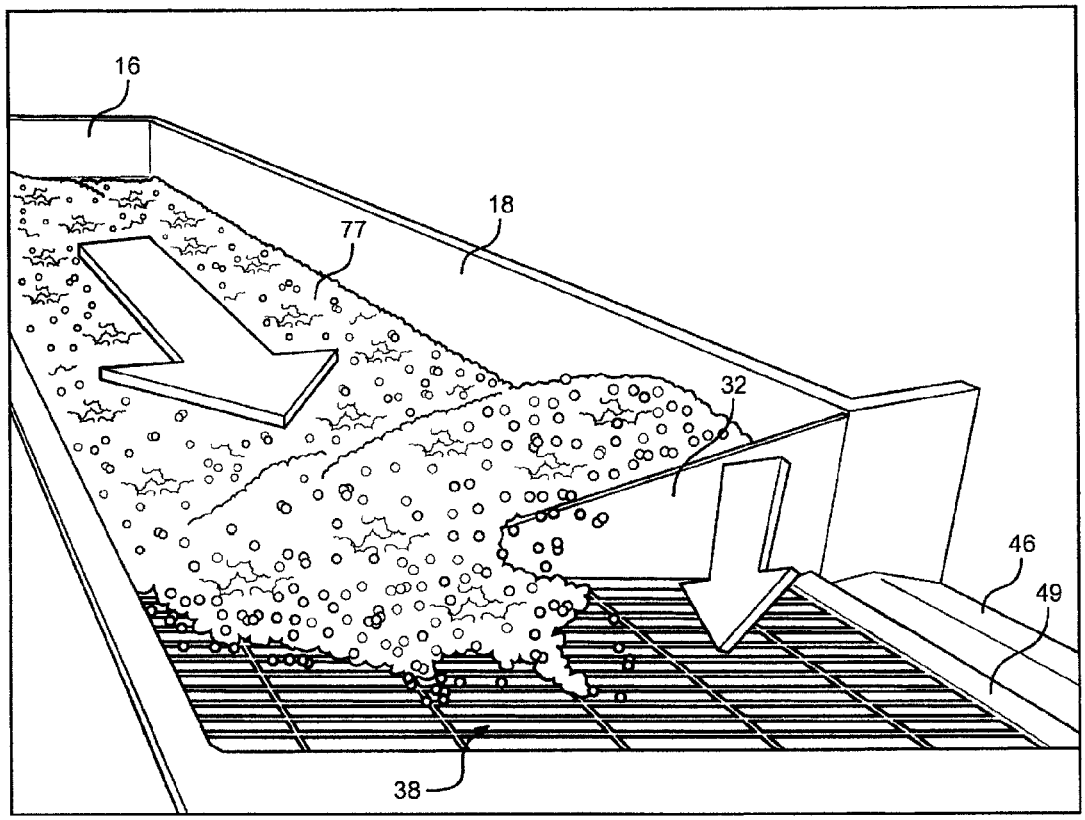
FIG. 5 is a perspective view of the apparatus in the upstream direction.

Downstream of deflector member 32 is provided a screen unit 38. Screen unit 38 includes a base section 40 which is substantially coplanar with platform 13, and an angled section 41 which slopes upwardly from base section 40 in a direction away from first end portion 10 of bed 11. Screen unit 38 is provided with a plurality of spaced openings 43 which preferably take the form of laterally elongated slots. As will be discussed more fully below, after the food product conveyed down bed 11 is processed to separate multiple pieces or remove additional clumped material to establish individual food pieces, the individual food pieces are adapted to pass through openings 43 prior to being delivered to processing station 6. Any food product which is too large to pass through openings 43 will be directed to a discharge chute 46. As perhaps best shown in FIG. 4, discharge chute 46 has an associated, raised lip 49 extending thereacross and separating discharge chute 46 from screen unit 38.

Although bed 11 can be constructed of various materials and configured in different ways without departing from the invention, a preferred embodiment of scalping apparatus 2 which is used in making individual puffed cereal pieces at a capacity of approximately 10,800 pounds per hour employs a bed 11 which is in the order of 30 inches (approximately 76 cm) wide and 161 inches (approximately 409 cm) long. Platform 13 is preferably formed of a smooth metal, such as seven gauge stainless steel. Generally, the end and side walls 16, 18, 20 and 25 extend upwardly in the order of 8 inches (approximately 20 cm), with deflector member 32, which can be laser cut-out from a 3/16 inch (approximately 0.5 cm) metal plate and bent, extending up to a maximum height in the order of 7-8 inches (approximately 18-20 cm). Screen unit 38 is preferably defined by a unitary, metal grade insert which can be readily removed from bed 11 for cleaning purposes. On the other hand, screen unit 38 can be made from multiple sections which can be individually removed. Openings 43 for the embodiment of making puffed cereal is depicted as being 3/4 inches (approximately 2 cm) wide and 5 inches (approximately 13 cm) long, while angled section 41 projects upwardly approximately 7 inches (approximately 18 cm) above base section 40. Again, these particular materials and dimensions are provided for the sake of completeness in describing a particularly preferred embodiment used in connection with making a standard puffed cereal which is discharged from a dryer station 5 and is conveyed by scalping apparatus 2 to processing station 6. At this point, it should also be noted that platform 13 has a few degrees of slope (preferably less than 5° and more preferably between)2°-3° relative to horizontal from both second upstanding side wall 20 towards first upstanding side wall 18 and from first end portion 10 to second end portion 23. This slope aids in conveying of food product along bed 11 and also enhances the draining off of washing fluid during cleansing of bed 11.

Figure 2:
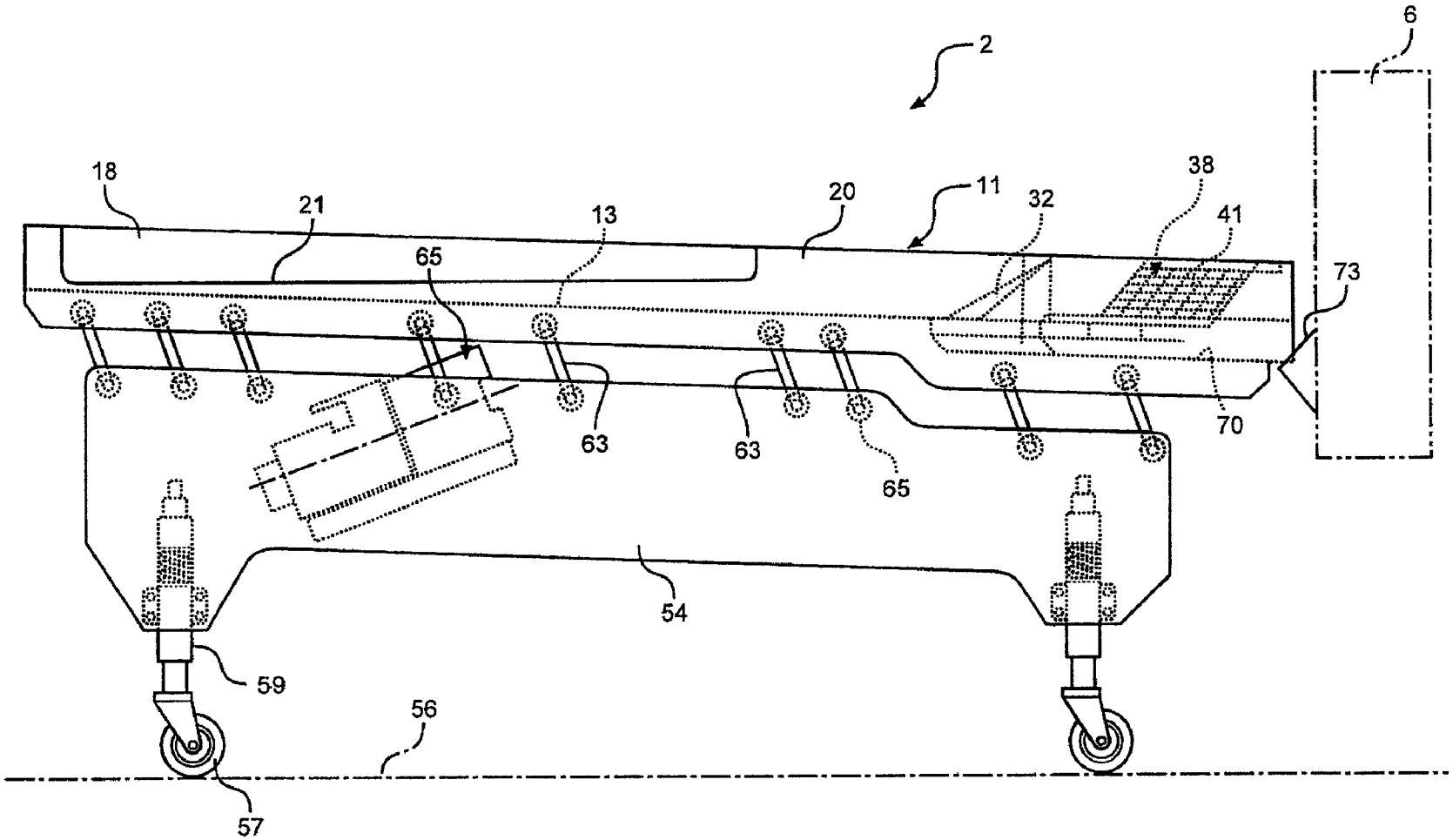
FIG. 2 is a side elevational view of the apparatus of FIG. 1.
Figure 3:
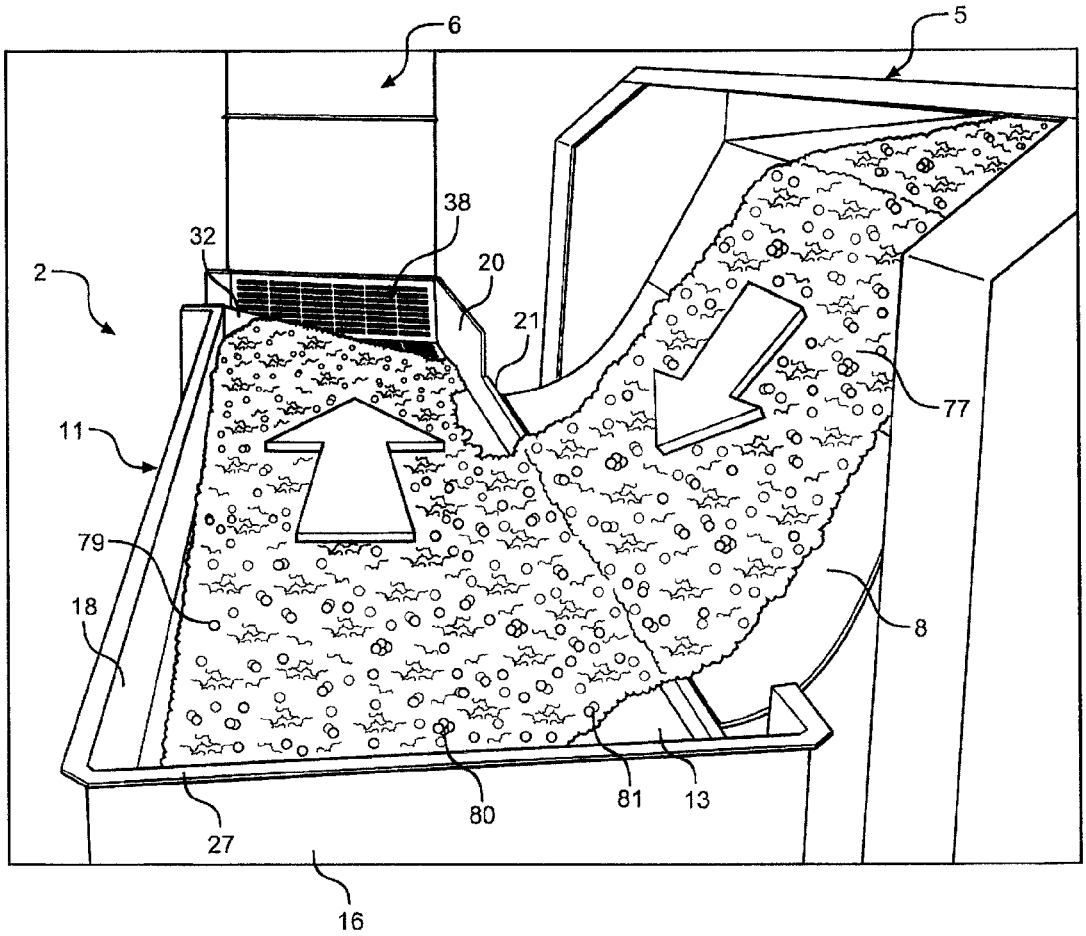
FIG. 3 illustrates the apparatus of FIG. 1 with product pieces flowing thereon.

In further accordance with the invention, apparatus 2 is preferably portable in nature. To this end, FIG. 2 is referenced in connection with a side elevational view of apparatus 2 showing one side of a frame 54 which supports bed 11. Frame 54 is supported on a floor surface 56 through various castors 57 and leg supports 59. In one particular embodiment of the invention, four castors 57 and corresponding leg supports 59 are employed in a manner analogous to a hospital bed. In order to accommodate vertical adjustability of bed 11, leg supports 59 can be telescoping such that bed 11 can be manually, pneumatically or hydraulically raised and lowered, thereby enabling the slope of platform 13 to be adjusted. Interposed between frame 54 and bed 11 are a plurality of suspension elements 63, each of which is angled with respect to the vertical. In a preferred form of the invention, suspension elements 63 are constituted by spring arms that are secured to each of frame 54 and bed 11 through respective isolation mounts and brackets (one of which is generally indicated at 65). Supported by frame 54 and operatively connected to bed 11 is a shaker mechanism 66 which is used to shake bed 11 during operation. In one preferred form, shaker mechanism 66 constitutes an electric motor operating at 390 RPMs with a stroke of 3/8 inch (approximately 1 cm). As further depicted in this figure, bed 11 also includes a lower pan or deck 70 which is provided at second end portion 23 below screen unit 38. Lower pan 70 receives the processed individual food pieces in accordance with the invention and delivers them to an intake 73 of second processing station 6.

Figure 6:
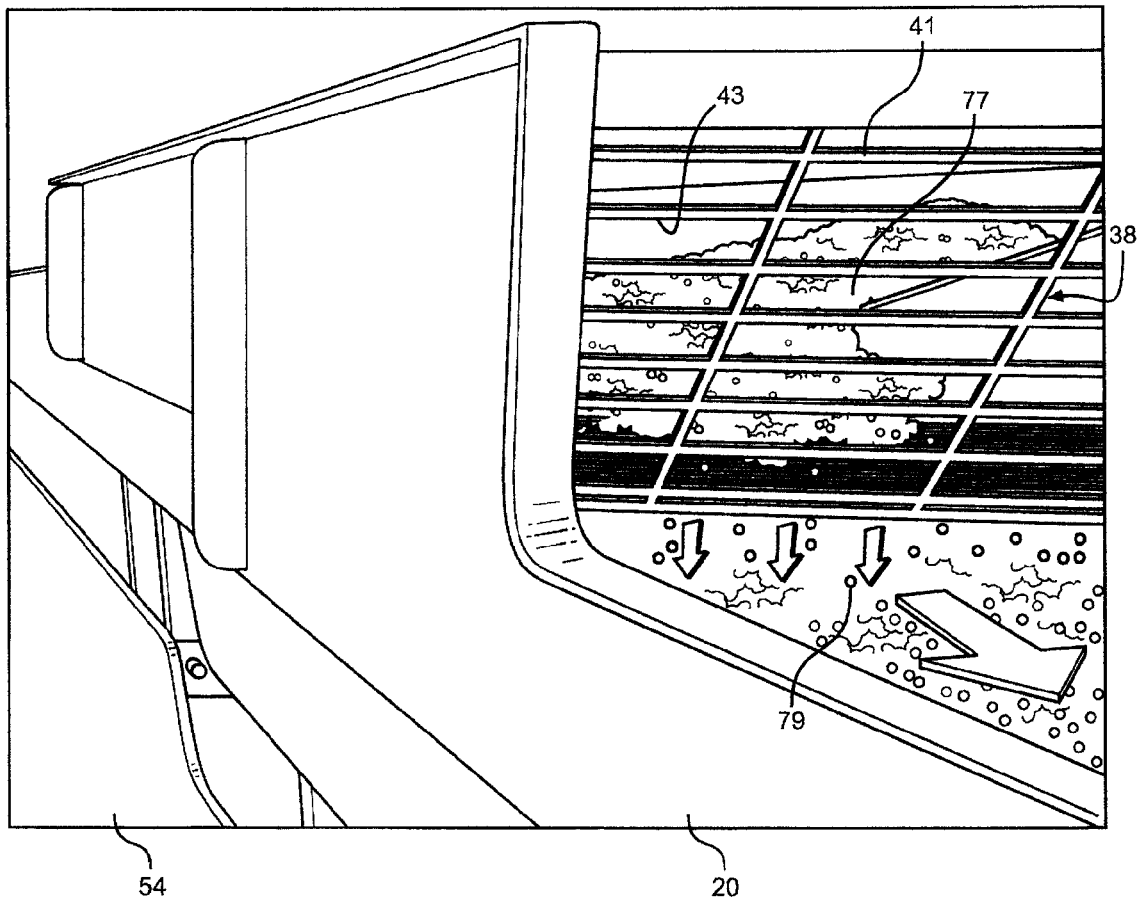
FIG. 6 is a partial, perspective view from below the screen unit of the apparatus.

Details of the operation and use of apparatus 2 will now be described in more detail with reference to FIGS. 3-7. With initial reference to FIG. 3, apparatus 2 is shown receiving puffed RTE cereal product 77 from dryer station 5, with the food product 77 being delivered along discharge ramp 8 onto first end portion 10 of bed 11 at cut-out section 21. In general, the overall food product 77 includes desired individual pieces represented at 79. However, in addition, food product 77 also includes multiple pieces which are joined together as indicated at 80, as well as pieces which have excessive clumped material attached thereto, such as indicated at 81. In addition to conveying food product 77 from dryer station 5 to processing station 6, apparatus 2 also performs the important function of scalping food product 77 in order to break up the multiple pieces 80 and remove the clumped material from pieces 81 such that all of the pieces can take the form of the individual pieces 79 which fit through the openings 43 so as to fall onto the lower pan 70 and be delivered to intake 73 of processing station 6. In addition to the sloping aspects of platform 13, the operation of shaker mechanism 66 provides for the conveyance of food product 77 from first end portion 10 to second end portion 23. Between first end portion 10 and deflector member 32, food product 77 really traverses smooth platform 13 in a collected, controlled manner prior to reaching screen unit 38. As perhaps best shown in FIGS. 4 and 5, deflector member 32 diverts food product 77 onto a portion of screen unit 38 which is remote from discharge chute 46. Upon reaching screen unit 38, the individual pieces 79 will readily fall through openings 43 and onto lower pan 70. On the other hand, multiple pieces 80 and the pieces 81 with clumped material will be effectively acted upon by the edges of screen unit 38 that define openings 43 based on the vibrating of screen unit 38 to cause the multiple pieces 82 to break apart and the clumped material to be shaved from pieces 81. In the art, this overall operation is generally referred to as "scalping" of the food product. Once the pieces achieve a requisite size established by the configuration of openings 43, they will fall onto lower pan 70 as best illustrated in FIG. 6. Lower pan 70 is also slightly sloped towards processing station 6 in a manner corresponding to platform 13 and is subjected to the action of shaker mechanism 66 to cause the individual pieces to be received within intake 73.

Figure 7:
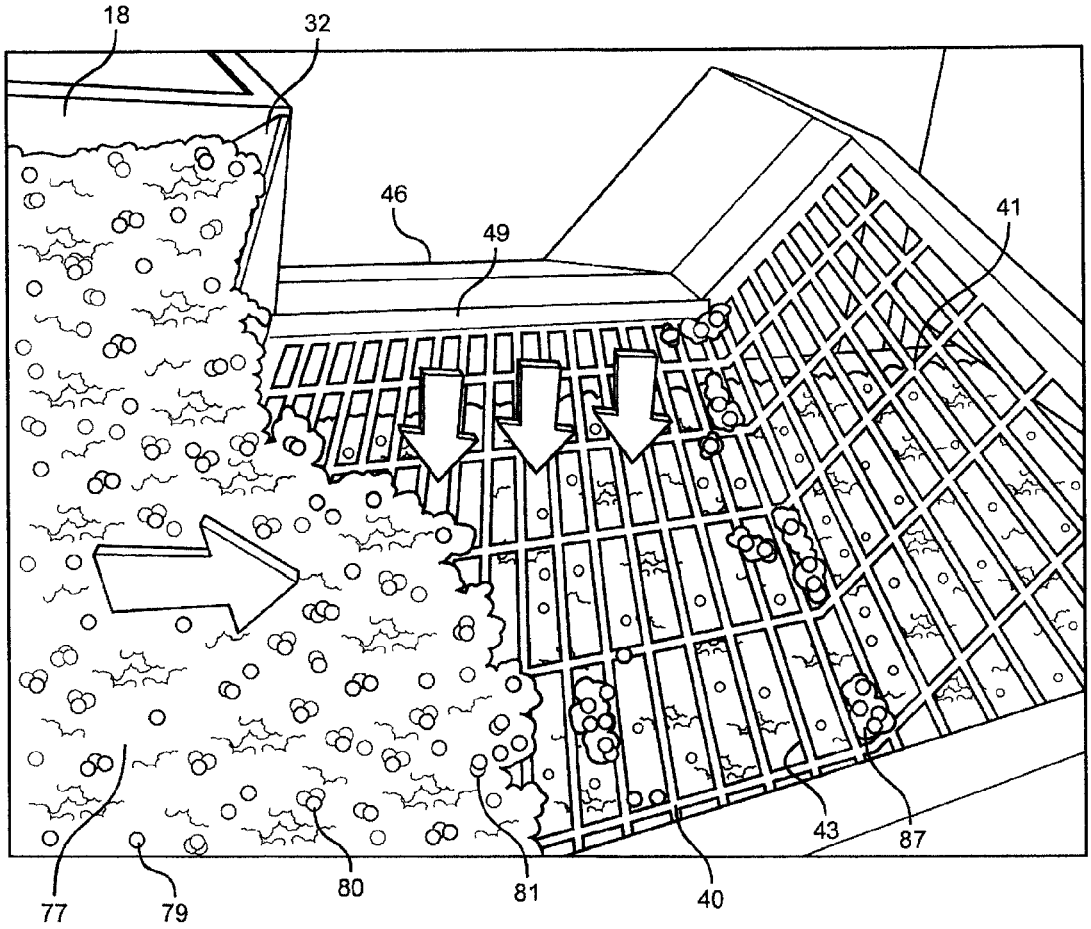
FIG. 7 is an upper perspective of the screen unit and a discharge chute of the apparatus.

Inevitably, there will be a certain percentage of food product 77 which will remain too large to ever fall through openings 43. This portion of food product 77 will have a tendency to work its way to the juncture of base section 40 and angled section 41 of screen unit 38. FIG. 7 illustrates some exemplified clumped or reject product at 87. Periodically, this clumped product 87 can be removed by wiping the product into the adjacent discharge chute 46. Again, it should be noted that discharge chute 46 has an associated raised lip 49 which, in combination with the diverting of food product 77 by deflector member 32, functions to retain all of food product 77 on screen unit 38 for prolonged processing, while also enabling clumped product 87 to be readily removed. In this sense, it is considered extremely advantageous in the embodiment shown to locate both deflector member 32 and discharge chute 46 directly adjacent screen unit 38.

Based on the above, it should be readily apparent that scalping apparatus 2 provides an extremely efficient and effective operation of scalping food product. It has been found that the short, terminal screen unit 38 in combination with the use of shaker mechanism 66 provides for significant jostling and effective scalping of the food product, while accommodating a surprisingly high capacity rate in a small amount of space. Particularly advantageous is considered to be the relative positioning of the screen unit, deflector member and discharge chute. However, it is also possible to employ a larger, angled screen in combination with a smaller discharge chute without the deflector member. In particular, the combination of the sloping screen and the relative location of the discharge chute provides an effective and efficient manner of directing rejected products to the discharge chute. Furthermore, the portable nature of the overall-bed and separator enables a quick and easy change out between the spaced processing stations, when needed, such that very little system down time is experienced. In any case, although described with reference to preferred embodiments of the invention, it should be readily understood that various changes and/or modifications can be made to the invention without departing from the spirit thereof. In general, the invention is only intended to be limited by the scope of the following claims.

I claim:

1. An apparatus for processing food pieces between two processing stations of a production facility comprising:

a transport bed defining a platform having a first end portion, adapted to receive food pieces from a first processing station, leading to a second end portion where food pieces are to be delivered to a second processing station;

a discharge chute provided at the second end portion of the transport bed; and a screen unit provided at the second end portion of the transport bed, said screen unit including a base section and an angled section sloping upwardly from the base section in a direction away from the first end portion of the transport bed, both the base section and the angled section of said screen unit including a plurality of spaced openings through which individual food pieces are adapted to pass prior to being delivered to the second processing station.

2. The apparatus according to claim 1 further comprising: a deflector member extending above the platform between the first end portion of the transport bed and each of the screen unit and the discharge chute, said deflector member being adapted to divert food pieces traveling along the transport bed onto the screen unit and away from the discharge chute.

3. The apparatus according to claim 2 wherein the platform is defined by a substantially smooth, solid surface.

4. The apparatus according to claim 3 wherein the platform slopes from the first end portion towards the second end portion and also laterally towards each of the deflector member and the discharge chute.

5. The apparatus according to claim 1 further comprising:

a shaker mechanism adapted to vibrate the transport bed in order to cause the food product to flow from the first end portion onto the screen unit and to cause scalping of at least some of the food pieces on the screen unit to either separate multiple attached food pieces or remove clumping from food pieces, thereby enabling the food pieces to pass through the screen unit; and a frame supporting the transport bed, the screen unit and the shaker mechanism, said frame being provided with wheels for readily repositioning the apparatus.

6. The apparatus according to claim 1 further comprising: a lip extending across the discharge chute and separating the discharge chute and the screen unit.

7. An apparatus for processing food pieces between two processing stations of a production facility comprising:

a transport bed defining a platform having a first end portion, adapted to receive food pieces from a first processing station, leading to a second end portion where food pieces are to be delivered to a second processing station;

a discharge chute provided at the second end portion of the transport bed;

a screen unit provided at the second end portion of the transport bed, said screen unit including a base section including a plurality of spaced openings through which individual food pieces are adapted to pass prior to being delivered to the second processing station; and a deflector member extending above the platform between the first end portion of the transport bed and each of the screen unit and the discharge chute, said deflector member being adapted to divert food pieces traveling along the transport bed onto the screen unit and away from the discharge chute.

8. The apparatus according to claim 7 wherein the deflector member is constituted by a substantially triangular, truncated pyramid shaped member extending from the base section.

9. The apparatus according to claim 7 wherein the platform is defined by a substantially smooth, solid surface.

10. The apparatus according to claim 9 wherein the platform slopes from the first end portion towards the second end portion and also laterally towards each of the deflector member and the discharge chute.

11. The apparatus according to claim 7 further comprising: a shaker mechanism adapted to vibrate the transport bed in order to cause the food product to flow from the first end portion onto the screen unit and to cause scalping of at least some of the food pieces on the screen unit to either separate multiple attached food pieces or remove clumping from food pieces, thereby enabling the food pieces to pass through the screen unit.

12. The apparatus according to claim 11 further comprising: a frame supporting the transport bed, the screen unit and the shaker mechanism, said frame being provided with wheels for readily repositioning the apparatus.

13. The apparatus according to claim 7 further comprising: a lip extending across the discharge chute and separating the discharge chute and the screen unit.

14. The apparatus according to claim 7 wherein the screen unit further includes an angled section sloping upwardly from the base section in a direction away from the first end portion of the transport bed.

15. An apparatus for processing food pieces between two processing stations of a production facility comprising:

a transport bed defining a platform having a first end portion, adapted to receive food pieces from a first processing station, leading to a second end portion where food pieces are to be delivered to a second processing station;

a discharge chute provided at the second end portion of the transport bed;

a screen unit provided at the second end portion of the transport bed, said screen unit including a base section and an angled section sloping upwardly from the base section in a direction away from the first end portion of the transport bed, said screen unit including a plurality of spaced openings through which individual food pieces are adapted to pass prior to being delivered to the second processing station;

a shaker mechanism adapted to vibrate the transport bed in order to cause the food product to flow from the first end portion onto the screen unit and to cause scalping of at least some of the food pieces on the screen unit to either separate multiple attached food pieces or remove clumping from food pieces, thereby enabling the food pieces to pass through the screen unit; and a deflector member extending above the platform between the first end portion of the transport bed and each of the screen unit and the discharge chute, said deflector member being adapted to divert food pieces traveling along the transport bed onto the screen unit and away from the discharge chute.

16. A method of scalping a food product to form individual, discretely sized food pieces comprising:

delivering food product onto a transport bed;

conveying the food product along the transport bed onto a screen unit including a base section and an angled section sloping upwardly from the base section in a direction away from the transport bed, both the base section and the angled section including a plurality of spaced holes; and scalping the food product on the screen unit until individual food pieces, sized to fall through the holes formed in the screen unit, are formed.

17. The method of claim 16 wherein both conveying the food product and scalping the food product includes vibrating the transport bed and the screen unit.

18. The method of claim 16 further comprising:

collecting some of the food product, which does not get reduced in size so as to fall through the holes, on the screen unit; and directing the collected food product to a discharge chute provided directly adjacent the screen unit.

19. The method of claim 18 further comprising: diverting the food pieces away from the discharge chute and to the upwardly sloping portion of the screen unit by a deflector member.

20. The method of claim 18 wherein directing the collected food product to the discharge chute requires the collected food product to raise over a lip provided across the discharge chute.

21. The method of claim 16 wherein the food pieces are constituted by ready-to-eat cereal food pieces.

* * * * *